US011427884B2

(12) United States Patent
Cui et al.

(10) Patent No.: US 11,427,884 B2
(45) Date of Patent: Aug. 30, 2022

(54) METHOD FOR TREATING FLUORINE-CONTAINING RARE EARTH MINERAL PARTICLES

(71) Applicants: BAOTOU RESEARCH INSTITUTE OF RARE EARTHS, Baotou (CN); NATIONAL ENGINEERING RESEARCH CENTRE OF RUIKE RARE EARTH METALLURGY AND FUNCTION MATERIALS CO., LTD., Baotou (CN)

(72) Inventors: Jianguo Cui, Baotou (CN); Zhe Wang, Baotou (CN); Ruien Hou, Baotou (CN); Dong Li, Baotou (CN); Meng Xu, Baotou (CN); Ting Gao, Baotou (CN); Xiaoli Hao, Baotou (CN); Bo Li, Baotou (CN); Yang Zhang, Baotou (CN)

(73) Assignees: NATIONAL ENGINEERING RESEARCH CENTRE OF RUIKE RARE EARTH METALLURGY AND FUNCTION MATERIALS CO., LTD., Baotou (CN); BAOTOU RESEARCH INSTITUTE OF RARE EARTHS, Baotou (CN)

( * ) Notice: Subject to any disclaimer, the term of this patent is extended or adjusted under 35 U.S.C. 154(b) by 331 days.

(21) Appl. No.: 16/630,311

(22) PCT Filed: Jun. 21, 2019

(86) PCT No.: PCT/CN2019/092296
§ 371 (c)(1),
(2) Date: Jan. 10, 2020

(87) PCT Pub. No.: WO2020/052311
PCT Pub. Date: Mar. 19, 2020

(65) Prior Publication Data

US 2021/0062295 A1 Mar. 4, 2021

(30) Foreign Application Priority Data

Sep. 14, 2018 (CN) ..... 201811072801.3

(51) Int. Cl.
*C22B 3/08* (2006.01)
*C22B 59/00* (2006.01)

(52) U.S. Cl.
CPC ..... *C22B 3/08* (2013.01); *C22B 59/00* (2013.01)

(58) Field of Classification Search
CPC ..... C22B 3/08; C22B 59/00
USPC ..... 75/743
See application file for complete search history.

(56) References Cited

FOREIGN PATENT DOCUMENTS

| | | | | |
|---|---|---|---|---|
| CN | 1683568 | A | | 10/2005 |
| CN | 102534269 | A | | 7/2012 |
| CN | 106978532 | A | | 7/2017 |
| CN | 109022838 | A | | 12/2018 |
| EP | 0418125 | A1 | * | 3/1991 |
| JP | 60090823 | A | * | 5/1985 |
| JP | S60090823 | A | | 5/1985 |
| JP | H03170625 | A | | 7/1991 |
| JP | 6896139 | B2 | | 6/2021 |

OTHER PUBLICATIONS

JP-60090823-A Translation (Year: 1985).*
EP-0418125-A1 Translation (Year: 1991).*
CN-106978532-A Translation (Year: 2017).*
International Search Report issued in International Application No. PCT/CN2019/092296 dated Sep. 16, 2019 (4 pages).
Written Opinion issued in International Application No. PCT/CN2019/092296 dated Sep. 16, 2019 (4 pages).
Office Action issued in corresponding JP Application No. 2020-500133 with English translation dated Jan. 6, 2021 (7 pages).
Decision to Grant issued in corresponding JP Application No. 2020-500133 with English translation dated May 20, 2021 (5 pages).
Supplementary European Search Report issued in corresponding EP Application No. 19823875.0 dated Nov. 20, 2020 (1 page).
Notification of Publication issued in corresponding EP Application No. 19823875.0 dated May 13, 2020 (2 pages).
Decision to Grant issued in corresponding EP Application No. 19823875.0 dated Dec. 16, 2021 (3 pages).
Office Action issued in corresponding CN Application No. 201811072801.3 with English translation dated Jul. 17, 2019 (7 pages).
Search Report issued in corresponding CN Application No. 201811072801.3 dated Jul. 4, 2019 (3 pages).
Search Report issued in corresponding CN Application No. 201811072801.3 dated Jan. 10, 2020 (2 pages).
Decision to Grant issued in corresponding CN Application No. 201811072801.3 with English translation dated Feb. 3, 2020 (3 pages).

(Continued)

*Primary Examiner* — Brian D Walck
*Assistant Examiner* — Danielle Carda
(74) *Attorney, Agent, or Firm* — Osha, Bergman, Watanabe & Burton LLP

(57) ABSTRACT

A method for treating fluorine-containing rare earth mineral particles may include mixing a first batch of the fluorine-containing rare earth mineral particles with a first sulfuric acid solution in a weight ratio in the range of 2-10:1 of the sulfuric acid in the first sulfuric acid solution to the first batch of fluorine-containing rare earth mineral particles, and heating the mixture to cause a liquid-solid reaction. The solid phase and liquid phase may be separated after the reaction to obtain an acid filtrate and an acid residue. The acid residue may be leached with water to obtain an aqueous leaching liquor that comprises a rare earth sulfate and an aqueous leaching residue. A second sulfuric acid solution may be added to the acid filtrate in an amount such that the sulfuric acid concentration of the acid filtrate is 40-85 wt %.

8 Claims, No Drawings

(56) References Cited

OTHER PUBLICATIONS

Extended European Search Report issued in corresponding EP Application No. 19823875.0 dated Nov. 3, 2020 (11 pages).

Kim, Rina et al. "Optimization of Acid Leaching of Rare-Earth Elements from Mongolian Apatite-Based Ore" Minerals 2016, 6, 63 (15 pages).

* cited by examiner

METHOD FOR TREATING FLUORINE-CONTAINING RARE EARTH MINERAL PARTICLES

TECHNICAL FIELD OF THE INVENTION

The present invention relates to a method for treating fluorine-containing rare earth mineral particles, in particular to a method for treating bastnaesite-containing rare earth mineral particles.

BACKGROUND OF THE INVENTION

Rare earth minerals mainly exist in the form of bastnaesite, mixed rare earth concentrate (bastnaesite and monazite), beach placer (monazite) and weathing crust strain amass-type rare earth ore. The representatives of bastnaesite are from Mountain Pass mine in the United States, Mianning rare earth mine in Sichuan Province and Weishanhu mine in Shandong Province in China. The typical representative of mixed type rare earth mineral is Baiyenebo rare earth minerals from Baotou area in Inner Mongolia in China. Therefore, it is of great significance to study the smelting separation technology of bastnaesite minerals. At present, the smelting technology of bastnaesite or bastnaesite in mixed type rare earth minerals has attracted more and more attention.

In one aspect, rare earth resources can be extracted with an air oxidizing roasting-hydrochloric acid dissolution technology. Bastnaesite mineral is decomposed into rare earth fluoride and rare earth oxide by oxidizing roasting. The concentration of hydrochloric acid and process of adding hydrochloric acid are controlled when the roasted ores are preferentially dissolved with hydrochloric acid, so as to extract trivalent rare earth and preliminarily separate from tetravalent cerium. Components such as cerium fluoride and cerium dioxide are retained in the residue, and can be used to prepare low-grade ferrosilicon alloy, or to extract tetravalent cerium with concentrated hydrochloric acid under the action of thiourea reductant. This process is widely used in the treatment of bastnaesite from Mianning in Sichuan Province. It can simply recover valuable rare earth at low cost. The problem of the above technical solution is that fluorine resources are not effectively used and rare earth resources are not completely extracted.

In another aspect, rare earth resources can be extracted with air oxidizing roasting-sulfuric acid dissolution technology. CN1683568A discloses a method of treating bastnaesite and separating cerium. Firstly, the bastnaesite concentrate is oxidizing roasted at 300-1000° C. to obtain bastnaesite calcine; the rare earth is leached out from the bastnaesite calcine with sulfuric acid, which is subjected to separation and reduction by coordination precipitant to separate trivalent rare earth elements from tetravalent rare earth elements, and to separate tetravalent cerium from tetravalent thorium. The problem of the above technical solution is that the bastnaesite concentrate must be oxidizing roasted at high temperature, and thus the process is too complicated.

In addition, there are a large amount of bastnaesite in the mixed type rare earth minerals, 90% of which are subjected to decomposition by concentrated sulfuric acid roasting process at high temperature. The mixed type rare earth minerals and concentrated sulfuric acid are roasted at high temperature of 500-1000° C. During the process, rare earth minerals and concentrated sulfuric acid contact and react, the solid-liquid phase changes into solid phase very quickly, and the reaction efficiency is very high. Therefore, the reaction makes high requirements on the particle size of raw mineral materials. When the size of mineral particles is greater than 200 mesh, the reaction rate will rapidly drop or the reaction will be terminated after a reaction on the surface is over. At the same time, in the reaction process, elements of fluorine and silicon in minerals and sulfur oxides from sulfuric acid decomposition enter the tail gas system, which makes it difficult to recycle fluorine resources.

CN106978532A discloses a method for extracting rare earth, fluorine and thorium from fluorine-contained rare earth minerals by concentrated sulfuric acid. The method comprises the following steps: the fluorine-contained rare earth minerals are mixed with the concentrated sulfuric acid; single fluorine-contained rare earth minerals or mixed rare earth concentrates contain 50-70 mass % of rare earth oxides; $H_2SO_4$ of the concentrated sulfuric acid is more than 90 mass %; the weight ratio of the fluorine-contained rare earth minerals to the concentrated sulfuric acid is 1:0.6-1.0; a mixture is fired for 120-300 min under the condition of 120-180° C.; a reaction product is leached with water, and then aqueous leaching liquor is neutralized to reach a pH value of 3.5-4.5 to form sulfuric acid rare earth solution and iron thorium enriched matters. Under the conditions of extremely low ratio of acid to minerals (the ratio of acid to minerals is 0.6-1.0:1) and extremely low reaction temperature (the temperature is 120-180° C.), the above technical solution realizes the transformation from solid-liquid phase to solid-solid phase, increases the reaction time, and realizes the preferential decomposition of bastnaesite. However, there are still the following problems in the above technical solution: first, it is difficult to control the end point of solid-solid phase reaction in the reaction process, and the decomposition rate of rare earth minerals must be ensured by recovering undecomposed minerals; second, when the process cannot be properly controlled, the reaction is terminated when the acidity of residual acid in the roasted minerals is very high, and a large amount of neutralizer is consumed in the process of aqueous leaching and impurity removal, with a waste of sulfuric acid.

CN102534269A discloses a method for comprehensively recycling various rare earth from rare earth materials containing fluorine, comprising the following steps: a. stirring the rare earth materials containing the fluorine with sulfuric acid, wherein hydrofluoric acid gas generated in the stirring process is used for preparing cryolite or hydrofluoric acid; b. leaching the stirred materials with water to obtain sulfuric rare earth solution. In the above technical solution, the sulfuric acid in step a is sulfuric acid with a concentration greater than 98%; the weight ratio of rare earth oxide in the rare earth material containing fluorine and sulfuric acid is 1:1.5-2; the addition amount of water during aqueous leaching in step b is controlled so that the concentration of rare earth in the aqueous leaching liquor is controlled at 90-110 g/L. Because the rare earth material containing fluorine and sulfuric acid react violently and release heat in the mixing process, the materials have already been in a semi-dry state. The above technical solution still has the following problems: first, due to too high concentration of sulfuric acid during mixing the reaction between concentrated sulfuric acid and bastnaesite is violent followed by a reaction rate changing greatly, so that it is difficult to control the reaction; second, the rare earth materials containing fluorine and sulfuric acid are mixed to form a semi-dry state, so the sulfuric acid is not easy to be recycled; third, it can treat only the activated bastnaesite after calcination or other reactions, but not the inactivated bastnaesite or mixed type rare earth concentrate.

In view of the defects of the prior arts, it is necessary to develop a method for treating the fluorine-containing rare earth mineral particles. The fluorine-containing rare earth mineral particles are decomposed by the liquid-solid phase mixing reaction in a lower concentration of sulfuric acid solution at a lower temperature, so as to realize the rapid decomposition of the fluorine-containing rare earth mineral particles. In addition, the reaction is easy to be controlled, and the residual acid resources are recycled.

SUMMARY OF THE INVENTION

In view of this, the purpose of the present invention is to provide a method for treating fluorine-containing rare earth mineral particles, wherein absolute excess sulfuric acid solution with a lower concentration is used to decompose the fluorine-containing rare earth mineral particles by liquid-solid phase mixing reaction at a lower temperature, so as to realize the rapid decomposition of fluorine-containing rare earth mineral particles. In addition, the reaction is easy to be controlled, and the residual acid resources are recycled.

The following technical solution is utilized in the present invention to achieve the above purposes.

The present invention provides a method for treating fluorine-containing rare earth mineral particles, comprising the following steps:

(1) mixing the first batch of fluorine-containing rare earth mineral particles with the first sulfuric acid solution according to the weight ratio of 2-10:1 of the sulfuric acid in the first sulfuric acid solution to the first batch of fluorine-containing rare earth mineral particles, and then heating the mixture for liquid-solid reaction, condensing and absorbing steam through a tail gas system, wherein a sulfuric acid concentration of the first sulfuric acid solution is 40-85 wt %;

(2) after the reaction, separating solid phase and liquid phase to obtain acid filtrate and acid residue;

(3) leaching the acid residue with water to obtain aqueous leaching liquor of rare earth sulfate and aqueous leaching residue;

(4) adding the second sulfuric acid solution to the acid filtrate so that the sulfuric acid concentration of the acid filtrate is 40-85 wt %; and then circularly executing the steps (1)-(3) for treating the $i^{th}$ batch of fluorine-containing rare earth mineral particles, wherein the character "i" is a natural number greater than or equal to 2;

wherein the first batch of fluorine-containing rare earth mineral particles and the $i^{th}$ batch of fluorine-containing rare earth mineral particles are rare earth mineral particles without performing roasting decomposition.

According to the method of the present invention, preferably, in step (1), the liquid-solid reaction is performed under continuous stirring, the reaction temperature is 100-180° C., and the reaction time is 0.5-5 hours.

According to the method of the present invention, preferably, in step (1), the liquid-solid reaction is performed under continuous stirring, the reaction temperature is 120-180° C., and the reaction time is 0.5-2 hours.

According to the method of the present invention, preferably, in step (1), the weight ratio of the sulfuric acid in the first sulfuric acid solution to the first batch of fluorine-containing rare earth mineral particles is 3-8:1.

According to the method of the present invention, preferably, the first batch of fluorine-containing rare earth mineral particles and the $i^{th}$ batch of fluorine-containing rare earth mineral particles are selected from one or two of the following: (A) bastnaesite, (B) mixed type rare earth concentrate of bastnaesite and monazite.

According to the method of the present invention, preferably, the first batch of fluorine-containing rare earth mineral particles and the $i^{th}$ batch of fluorine-containing rare earth mineral particles have a particle size of less than 150 mesh.

According to the method of the present invention, preferably, the first batch of fluorine-containing rare earth mineral particles and the $i^{th}$ batch of fluorine-containing rare earth mineral particles have a particle size of less than 200 mesh.

According to the method of the present invention, preferably, in step (1), the sulfuric acid concentration of the first sulfuric acid solution is 50-85 wt %; and in step (4) the second sulfuric acid solution is added to the acid filtrate so that the sulfuric acid concentration of the acid filtrate is 50-85 wt %.

According to the method of the present invention, preferably, in step (1), the sulfuric acid concentration of the first sulfuric acid solution is 60-75 wt %; and in step (4), the second sulfuric acid solution is added to the acid filtrate so that the sulfuric acid concentration of the acid filtrate is 60-75 wt %.

According to the method of the present invention, preferably, in step (3), the concentration of the rare earth sulfate in the rare earth sulfate aqueous leaching liquor is 20-45 g/L, calculated based on the rare earth oxide REO.

In the present invention, absolute excess sulfuric acid solution with a lower concentration is used to decompose the fluorine-containing rare earth mineral particles by liquid-solid phase mixing reaction at a lower temperature, so as to realize the rapid decomposition of the fluorine-containing rare earth mineral particles. In addition, the reaction is easy to be controlled, and the residual acid resources are recycled. In the present invention, the liquid-solid reaction is circularly applied to directly decompose the inactivated bastnaesite or mixed type rare earth concentrate; thereby the cost of rare earth extraction is significantly reduced. According to the preferred technical solution of the invention, the weight ratio of sulfuric acid to fluorine-containing rare earth mineral particles is 3-5:1, and the following technical problem is solved by using absolute excess sulfuric acid solution with a lower concentration: a great change in reaction rate of concentrated sulfuric acid and bastnaesite, and it is difficult to control the reaction.

DETAIL DESCRIPTION OF THE INVENTION

The present invention will be further explained in combination with specific embodiments, but the protection scope of the present invention is not limited thereto.

In the present invention, "select from" or "selected from" refers to the selection of individual components or the combination of two (or more) components.

The method for treating fluorine-containing rare earth mineral particles according to the present invention, comprising the following steps: (1) performing liquid-solid reaction of the first batch of fluorine-containing rare earth mineral particles and the first sulfuric acid solution; (2) separating solid phase and liquid phase to obtain acid filtrate and acid residue; (3) treating the acid residue; (4) adding the second sulfuric acid solution to the acid filtrate, and then circularly executing the steps (1)-(3) for treating the $i^{th}$ batch of fluorine-containing rare earth mineral particles, wherein "i" is a natural number greater than or equal to 2.

In step (1) of the method according to the present invention, both the first batch of fluorine-containing rare earth mineral particles and the $i^{th}$ batch of fluorine-containing rare earth mineral particles are selected from one or two of the following: (A) bastnaesite, (B) mixed type rare earth concentrate of bastnaesite and monazite. The first batch of fluorine-containing rare earth mineral particles and the $i^{th}$ batch of fluorine-containing rare earth mineral particles are rare earth mineral particles without performing roasting decomposition. The method of the present invention is suitable to fluorine-containing rare earth mineral particles that have not been subjected to roasting decomposition; thereby the cost of rare earth extraction can be significantly reduced.

In step (1) of the method according to the present invention, the mixed raw material is the first batch of fluorine-containing rare earth mineral particles and the first sulfuric acid solution. The sulfuric acid concentration of the first sulfuric acid solution is 40-85 wt %; preferably, the sulfuric acid concentration of the first sulfuric acid solution is 50-85 wt %; more preferably, the sulfuric acid concentration of the first sulfuric acid solution is 60-75 wt %. The weight ratio of the sulfuric acid (i.e., solute) in the first sulfuric acid solution to the first batch of fluorine-containing rare earth mineral particles is 2-10:1; preferably, the weight ratio of the sulfuric acid in the first sulfuric acid solution to the first batch of fluorine-containing rare earth mineral particles is 3-8:1; more preferably, the weight ratio of the sulfuric acid in the first sulfuric acid solution to the first batch of fluorine-containing rare earth mineral particles is 3-5:1. According to an embodiment of the present invention, the weight ratio of the sulfuric acid in the first sulfuric acid solution to the bastnaesite from Mianning in Sichuan Province is 3.4-3.8:1. According to another embodiment of the present invention, the weight ratio of the sulfuric acid in the first sulfuric acid solution to the mixed rare earth concentrate from Baiyenebo is 4-5:1.

In step (1) of the method according to the present invention, the liquid-solid reaction is performed under continuous stirring. General mechanical agitation may be used. The liquid-solid reaction temperature is 100-180° C.; preferably, the liquid-solid reaction temperature is 120-180° C.; more preferably, the liquid-solid reaction temperature is 130-180° C. The liquid-solid reaction time is 0.5-5 hours; preferably, the liquid-solid reaction time is 0.5-3 hours; more preferably, the liquid-solid reaction time is 0.5-2 hours. Steam may be generated during liquid-solid reaction, and it contains a lot of hydrofluoric acid gas. The hydrofluoric acid gas is condensed and absorbed through the tail gas system to obtain hydrofluoric acid products. According to an embodiment of the present invention, the liquid-solid reaction temperature is 140-150° C., and the reaction time is 1-1.5 hours. According to another embodiment of the present invention, for the first batch of mixed rare earth concentrate from Baiyenebo, the liquid-solid reaction temperature is 170-180° C., and the reaction time is 0.5-1 hours; for the second batch of mixed rare earth concentrate from Baiyenebo, the liquid-solid reaction temperature is 150-160° C., and the reaction time is 1-1.5 hours; for the third batch of mixed rare earth concentrate from Baiyenebo, the liquid-solid reaction temperature is 130-135° C., and the reaction time is 1.5-2 hours; for each one of the following 15 rounds of circular execution, the liquid-solid reaction temperature is 130-135° C., and the reaction time is 1.5-2 hours.

In step (2) of the method according to the present invention, solid phase and liquid phase are separated after the liquid-solid reaction to obtain acid filtrate and acid residue. Rare earth products can be obtained by treating the acid residue. In the liquid-solid reaction, absolute excess sulfuric acid solution with a lower concentration is used. The sulfuric acid solution is of a greatly excessive amount. The fluorine-containing rare earth mineral particles are completely immersed in the sulfuric acid solution. There are relatively large amount of sulfuric acid solutions left after the reaction, and the remaining sulfuric acid solution (acid filtrate) can be recycled. According to an embodiment of the present invention, in the treatment of the first batch of bastnaesite from Mianning in Sichuan Province, solid phase and liquid phase are separated after the reaction, and the first batch of acid filtrate and the first batch of acid residue are obtained. According to another embodiment of the present invention, in the treatment of the first batch of mixed rare earth concentrate from Baiyenebo, solid phase and liquid phase are separated after the reaction, and the first batch of acid filtrate and the first batch of acid residue are obtained.

In step (3) of the method according to the present invention, the acid residue is leached with water to obtain aqueous leaching liquor of rare earth sulfate and aqueous leaching residue. In case of that fluorine-containing rare earth mineral particles are bastnaesite, the bastnaesite decomposition rate is ≥95%, calculated based on the rare earth oxide (REO) in the aqueous leaching residue; in case of that fluorine-containing rare earth mineral particles are the mixed type rare earth concentrate of bastnaesite and monazite, the bastnaesite decomposition rate is ≥95%, calculated based on the F content in the aqueous leaching residue. According to an embodiment of the present invention, the fluorine-containing rare earth mineral particles are bastnaesite from Mianning in Sichuan Province, the bastnaesite decomposition rate is ≥96% in the multi-round of circular execution, calculated based on the rare earth oxide (REO) in the aqueous leaching residue. According to another embodiment of the present invention, the fluorine-containing rare earth mineral particles are the mixed type rare earth concentrate from Baiyenebo, the bastnaesite decomposition rate is ≥96% in the multi-round of circular execution, calculated based on the F content in the aqueous leaching residue.

In step (3) of the method according to the present invention, when the acid residue is leached with water, the amount of water is 10-50 times of the weight of the first batch of fluorine-containing rare earth mineral particles; preferably, the amount of water is 10-35 times of the weight of the first batch of fluorine-containing rare earth mineral particles; more preferably, the amount of water is 15-25 times of the weight of the first batch of fluorine-containing rare earth mineral particles. According to an embodiment of the present invention, liquid-solid reaction is performed circularly to decompose bastnaesite from Mianning in Sichuan Province, in which the first batch of acid residue is leached with 1500-2000 mL of water. The amount of water is 15-20 times of the weight of bastnaesite from Mianning in Sichuan Province. According to another embodiment of the present invention, liquid-solid reaction is performed circularly to decompose the mixed rare earth concentrate from Baiyenebo, in which the first batch of acid residue is leached with 1500-2000 mL of water. The amount of water is 15-20 times of the weight of the mixed rare earth concentrate from Baiyenebo.

In the aqueous leaching liquor of rare earth sulfate, the concentration of rare earth sulfate is 20-45 g/L calculated based on the rare earth oxide (REO), preferably 25-40 g/L, more preferably 30-35 g/L. According to a specific embodiment of the present invention, liquid-solid reaction is performed circularly to decompose bastnaesite from Mianning in Sichuan Province, the first batch of acid residue is leached with 1500-2000 mL of water, the concentration of rare earth sulfate in the aqueous leaching liquor of rare earth sulfate is 25.0-26.7 g/L calculated based on the rare earth oxide (REO); the second batch of acid residue is leached with 1500-2000 mL of water, the concentration of rare earth sulfate in the aqueous leaching liquor of rare earth sulfate is 28.0-30.2 g/L calculated based on the rare earth oxide (REO); the third batch of acid residue is leached with 1500-2000 mL of water, the concentration of rare earth sulfate in the aqueous leaching liquor of rare earth sulfate is 32-34.7 g/L calculated based on the rare earth oxide (REO); the fourth batch of acid residue is leached with 1500-2000 mL of water, the concentration of rare earth sulfate in the aqueous leaching liquor of rare earth sulfate is 32-33.6 g/L calculated based on the rare earth oxide (REO); after the following 4-10 rounds of circular execution, the concentration of rare earth sulfate in the aqueous leaching liquor of rare earth sulfate is 32.5-33 g/L calculated based on the rare earth oxide (REO). According to another specific embodiment of the present invention, liquid-solid reaction is performed circularly to decompose the mixed rare earth concentrate from Baiyenebo, the first batch of acid residue is leached with 1500-2000 mL of water, the concentration of rare earth sulfate in the aqueous leaching liquor of rare earth sulfate is 22-23.3 g/L calculated based on the rare earth oxide (REO); the second batch of acid residue is leached with 1500-2000 mL of water, the concentration of rare earth sulfate in the aqueous leaching liquor of rare earth sulfate is 28.0-30.7 g/L calculated based on the rare earth oxide (REO); the third batch of acid residue is leached with 1500-2000 mL of water, the concentration of rare earth sulfate in the aqueous leaching liquor of rare earth sulfate is 32-34.5 g/L calculated based on the rare earth oxide (REO); after the following 15-18 rounds of circular execution, the concentration of rare earth sulfate in the aqueous leaching liquor of rare earth sulfate is 32.5-33 g/L calculated based on the rare earth oxide (REO).

In step (4) of the method according to the present invention, after the second sulfuric acid solution is added to the acid filtrate, circularly executing the steps (1)-(3) for treating the $i^{th}$ batch of fluorine-containing rare earth mineral particles. The character "i" is a natural number greater than or equal to 2, for example, it can be 2, 3, 4, 5, 6, 7, 8 and so on. Before each round of liquid-solid reaction, the initial mass fraction of sulfuric acid solution is 40-85 wt %; preferably, before each round of liquid-solid reaction, the initial mass fraction of sulfuric acid solution is 50-85 wt %; more preferably, before each round of liquid-solid reaction, the initial mass fraction of sulfuric acid solution is 60-75 wt %. When the second sulfuric acid solution is added, its addition amount is based on the actual consumption of sulfuric acid in the previous round of liquid-solid reaction. The sulfuric acid concentration of the second sulfuric acid solution is ≥90 wt %; preferably, the sulfuric acid concentration of the second sulfuric acid solution is ≥95 wt %; more preferably, the sulfuric acid concentration of the second sulfuric acid solution is ≥98 wt %. According to a specific embodiment of the present invention, 60-72 g of concentrated sulfuric acid with concentration of 98 wt % is added to the first batch of acid filtrate, calculated based on treating 100 g of the second batch of bastnaesite. 60-68 g of concentrated sulfuric acid with concentration of 98 wt % is added into the second batch of acid filtrate, calculated based on treating 100 g of the third batch of bastnaesite. 65-72 g of concentrated sulfuric acid with concentration of 98 wt % is added into the third batch of acid filtrate, calculated based on treating 100 g of the fourth batch of bastnaesite. For the following 4-8 rounds of circular execution, 53-55 g of concentrated sulfuric acid with concentration of 98 wt % is added into the acid filtrate in the last round of each round, calculated based on treating 100 g of the $i^{th}$ batch of bastnaesite.

In step (4) of the method according to the present invention, the temperature of liquid-solid reaction in each circular execution is 100-180° C., preferably 120-180° C., more preferably 130-180° C. The time of liquid-solid reaction in each circular execution is 0.5-5 hours, preferably 0.5-3 hours, more preferably 0.5-2 hours. Steam may be generated during liquid-solid reaction of each circular execution, and it contains a lot of hydrofluoric acid gas. The hydrofluoric acid gas is condensed and absorbed through the tail gas system to obtain hydrofluoric acid products. In each circular execution, solid phase and liquid phase are separated after the liquid-solid reaction, and acid filtrate and acid residue are obtained. Rare earth products can be obtained by treating the acid residue.

The method for treating fluorine-containing rare earth mineral particles according to the present invention also comprises the step of crushing fluorine-containing rare earth mineral particles.

In the step of crushing fluorine-containing rare earth mineral particles, the fluorine-containing rare earth mineral particles are crushed to a particle size of less than 150 mesh; preferably, the fluorine-containing rare earth mineral particles are crushed to a particle size of less than 200 mesh. This can facilitate the decomposition of the fluorine-containing rare earth mineral particles. If the fluorine-containing rare earth mineral particles have a particle size of less than 150 mesh, they need not to be crushed, and thus the crushing procedure can be omitted. According to a specific embodiment of the present invention, the bastnaesite is crushed to a particle size of less than 150 mesh to obtain the bastnaesite particles. According to another specific embodiment of the present invention, the particle size of mixed type rare earth concentrate of bastnaesite and monazite is less than 200 mesh.

Example 1

The crushing of the bastnaesite from Mianning in Sichuan Province: the bastnaesite from Mianning in Sichuan Province with REO content of 68.2 wt % was crushed to a particle size of less than 150 mesh, and the bastnaesite particles were obtained.

(1) Treatment of the First Batch of Bastnaesite from Mianning in Sichuan Province 100 g of crushed bastnaesite from Mianning in Sichuan Province without performing roasting decomposition was mixed with 485 g of sulfuric acid solution with a concentration of 70 wt % (the weight ratio of sulfuric acid to bastnaesite is 3.4:1); the mixture was heated with stirring, and reacted at 140° C. for 1 hour, and steam was condensed and absorbed through tail gas system to obtain hydrofluoric acid products. The solid phase and the liquid phase were separated after the liquid-solid reaction, and the first batch of acid filtrate and the first batch of acid residue were obtained. The first batch of acid residue was leached with 2000 mL of water, and the aqueous leaching liquor of rare earth sulfate and the aqueous leaching residue were obtained. The concentration of rare earth sulfate in the aqueous leaching liquor was 26.7 g/L calculated based on REO. The decomposition rate of bastnaesite is 98.2% calculated based on REO in the aqueous leaching residue.

(2) Treatment of the Second Batch of Bastnaesite 72 g of concentrated sulfuric acid with a concentration of 98 wt % was added to the first batch of acid filtrate under stirring, till the concentration of sulfuric acid was 70 wt %. 100 g of the second batch of bastnaesite from Mianning in Sichuan Province with REO content of 68.2 wt % was treated. The treatment conditions of acid amount, initial concentration of sulfuric acid, reaction temperature and reaction time were identical to those in the treatment of the first batch of bastnaesite from Mianning in Sichuan Province. The solid phase and the liquid phase were separated after the liquid-solid reaction, and the second batch of acid filtrate and the second batch of acid residue were obtained. The second batch of acid residue was leached with 2000 mL of water, and the aqueous leaching liquor and the aqueous leaching residue of rare earth sulfate were obtained. The concentration of rare earth sulfate in the aqueous leaching liquor was 30.2 g/L calculated based on REO. The decomposition rate of bastnaesite is 96.7% calculated based on REO in the aqueous leaching residue.

(3) Treatment of the Third Batch of Bastnaesite 68 g of concentrated sulfuric acid with a concentration of 98 wt % was added to the second batch of acid filtrate under stirring, till the concentration of sulfuric acid was 70 wt %. The third batch of bastnaesite from Mianning in Sichuan Province with REO content of 68.2 wt % was treated. The treatment conditions of acid amount, initial concentration of sulfuric acid, reaction temperature and reaction time were identical to those in the treatment of the first batch of bastnaesite from Mianning in Sichuan Province. The solid phase and the liquid phase were separated after the liquid-solid reaction, and the third batch of acid filtrate and the third batch of acid residue were obtained. The third batch of acid residue was leached with 2000 mL of water, and the aqueous leaching liquor and the aqueous leaching residue of rare earth sulfate were obtained. The concentration of rare earth sulfate in the aqueous leaching liquor was 34.7 g/L calculated based on REO. The decomposition rate of bastnaesite is 96.3% calculated based on REO in the aqueous leaching residue.

(4) Treatment of the Fourth Batch of Bastnaesite 72 g of concentrated sulfuric acid with a concentration of 98 wt % was added to the third batch of acid filtrate under stirring, till the concentration of sulfuric acid was 70 wt %. The fourth batch of bastnaesite from Mianning in Sichuan Province with REO content of 68.2 wt % was treated. The treatment conditions of acid amount, initial concentration of sulfuric acid, reaction temperature and reaction time were identical to those in the treatment of the first batch of bastnaesite from Mianning in Sichuan Province. The solid phase and the liquid phase were separated after the liquid-solid reaction, and the fourth batch of acid filtrate and the fourth batch of acid residue were obtained. The fourth batch of acid residue was leached with 2000 mL of water, and the aqueous leaching liquor and the aqueous leaching residue of rare earth sulfate were obtained. The concentration of rare earth sulfate in the aqueous leaching liquor was 33.6 g/L calculated based on REO. The decomposition rate of bastnaesite is 96.5% calculated based on REO in the aqueous leaching residue.

(5) Circularly Executing the Steps for Treating the $i^{th}$ Batch of Bastnaesite After four other rounds of circular execution, treating conditions for each round of circular execution was as follows: the addition amount of concentrated sulfuric acid with a concentration of 98 wt % was 53-55 g, the initial concentration of sulfuric acid was 70 wt %, the reaction temperature was 140° C., and the reaction time was 1 hour. The concentration of rare earth sulfate in the aqueous leaching liquor was 32.5-33 g/L calculated based on REO.

Example 2

The mixed rare earth concentrate from Baiyenebo: the mixed rare earth concentrate from Baiyenebo has a REO content of 61.9 wt % and a particle size of less than 200 mesh. The mixed rare earth concentrate from Baiyenebo is the mixed type rare earth concentrate of bastnaesite and monazite.

(1) Treatment of the First Batch of Mixed Rare Earth Concentrate from Baiyenebo 100 g of the mixed rare earth concentrate from Baiyenebo without performing roasting decomposition was mixed with 590 g of sulfuric acid solution with a concentration of 85 wt % (the weight ratio of sulfuric acid to mixed rare earth concentrate from Baiyenebo is 5:1); the mixture was heated with stirring, and reacted at 180° C. for 0.5 hour, and steam was condensed and absorbed through tail gas system to obtain hydrofluoric acid products. The solid phase and the liquid phase were separated after the liquid-solid reaction, and the first batch of acid filtrate and the first batch of acid residue were obtained. The first batch of acid residue was leached with 2000 mL of water, and the aqueous leaching liquor and the aqueous leaching residue of rare earth sulfate were obtained. The concentration of rare earth sulfate in the aqueous leaching liquor was 23.3 g/L calculated based on REO. The decomposition rate of bastnaesite is 97.5% calculated based on the F content in the aqueous leaching residue.

(2) Treatment of the Second Batch of Mixed Rare Earth Concentrate from Baiyenebo 100 g of the second batch of mixed rare earth concentrate from Baiyenebo with REO content of 61.9 wt % was treated with the first batch of acid filtrate under stirring. The initial concentration of sulfuric acid was 73 wt %, the reaction temperature was 150° C., and the reaction time was 1 hour. The solid phase and the liquid phase were separated after the liquid-solid reaction, and the second batch of acid filtrate and the second batch of acid residue were obtained. The second batch of acid residue was leached with 2000 mL of water, and the aqueous leaching liquor and the aqueous leaching residue of rare earth sulfate were obtained. The concentration of rare earth sulfate in the aqueous leaching liquor was 30.7 g/L calculated based on REO. The decomposition rate of bastnaesite is 96.2% calculated based on the F content in the aqueous leaching residue.

(3) Treatment of the Third Batch of Mixed Rare Earth Concentrate from Baiyenebo 100 g of the third batch of mixed rare earth concentrate from Baiyenebo with REO content of 61.9 wt % was treated with the second batch of acid filtrate under stirring. The initial concentration of sulfuric acid was 64 wt %, the reaction temperature was 130° C., and the reaction time was 2 hour. The solid phase and the liquid phase were separated after the liquid-solid reaction, and the third batch of acid filtrate and the third batch of acid residue were obtained. The third batch of acid residue was leached with 2000 mL of water, and the aqueous leaching liquor and the aqueous leaching residue of rare earth sulfate were obtained. The concentration of rare earth sulfate in the aqueous leaching liquor was 34.5 g/L calculated based on REO. The decomposition rate of bastnaesite is 97.7% calculated based on the F content in the aqueous leaching residue.

(4) Circularly Executing the Steps for Treating the $i^{th}$ Batch of Mixed Rare Earth Concentrate from Baiyenebo After other 15 rounds of circular execution, treating conditions for each round of circular execution was as follows: the addition amount of concentrated sulfuric acid with a concentration of 98 wt % was 53-55 g, the initial concentration of sulfuric acid was 62 wt %, the reaction temperature was 130° C., the reaction time was 2 hour, and the weight ratio of sulfuric acid to mixed rare earth concentrate from Baiyenebo was 2.5:1. The concentration of rare earth sulfate in the aqueous leaching liquor was 32.5-33 g/L calculated based on REO. The decomposition rate of bastnaesite was 96-98%, and the decomposition rate of REO in the mixed rare earth concentrate from Baiyenebo was 58-60%, calculated based on the F content in the aqueous leaching residue.

The present invention is not limited by the above embodiments. All variations, modifications and replacements to the disclosed embodiments which are apparent to those skilled in the art and do not depart from the essence of the present invention fall in the scope of the present invention.

What is claimed is:

1. A method for treating fluorine-containing rare earth mineral particles, comprising:

(1) mixing a first batch of the fluorine-containing rare earth mineral particles with a first sulfuric acid solution in a weight ratio in the range of 2-10:1 of the sulfuric acid in the first sulfuric acid solution to the first batch of fluorine-containing rare earth mineral particles, and heating the mixture to cause a liquid-solid reaction;

(2) separating the solid phase and liquid phase after the reaction to obtain an acid filtrate and an acid residue;

(3) leaching the acid residue with water to obtain an aqueous leaching liquor that comprises a rare earth sulfate, and an aqueous leaching residue;

(4) adding a second sulfuric acid solution to the acid filtrate in an amount such that the sulfuric acid concentration of the acid filtrate is 50-85 wt %; and then performing the steps (1)-(3) i times for treating further batches of fluorine-containing rare earth mineral particles up to the $i^{th}$ batch, wherein the character "i" is a natural number greater than or equal to 2 and wherein each performance of the steps (1)-(3) treats one batch;

wherein the fluorine-containing rare earth mineral particles have not been subjected to roasting decomposition, wherein the liquid-solid reaction generates steam which is condensed and absorbed through a tail gas system, and wherein a sulfuric acid concentration of the first sulfuric acid solution is 50-85 wt %, wherein the concentration of the rare earth sulfate in the aqueous leaching liquor is 20-45 g/L, as calculated based on a rare earth oxide.

2. The method according to claim 1, wherein the liquid-solid reaction is performed under continuous stirring, a reaction temperature is 100-180° C., and a reaction time is 0.5-5 hours.

3. The method according to claim 1, wherein the liquid-solid reaction is performed under continuous stirring, a reaction temperature is 120-180° C., and a reaction time is 0.5-2 hours.

4. The method according to claim 1, wherein the weight ratio of the sulfuric acid in the first sulfuric acid solution to the first batch of fluorine-containing rare earth mineral particles is in the range of 3-8:1.

5. The method according to claim 1, wherein the fluorine-containing rare earth mineral particles are selected from one or two of the group consisting of bastnaesite and a mixed type rare earth concentrate of bastnaesite and monazite.

6. The method according to claim 5, wherein the fluorine-containing rare earth mineral particles have a particle size of less than 150 mesh.

7. The method according to claim 5, wherein the fluorine-containing rare earth mineral particles have a particle size of less than 200 mesh.

8. The method according to claim 1, wherein the sulfuric acid concentration of the first sulfuric acid solution is 60-75 wt %, and the second sulfuric acid solution is added to the acid filtrate in an amount such that the sulfuric acid concentration of the acid filtrate is 60-75 wt %.

* * * * *